US007073471B1

(12) United States Patent
Mead

(10) Patent No.: US 7,073,471 B1
(45) Date of Patent: Jul. 11, 2006

(54) APPARATUS AND METHOD FOR IMPROVING ENGINE PERFORMANCE

(76) Inventor: Gregory Damian Mead, 11258 Regentview Ave., Downey, CA (US) 90241

( * ) Notice: Subject to any disclaimer, the term of this patent is extended or adjusted under 35 U.S.C. 154(b) by 0 days.

(21) Appl. No.: 11/235,816

(22) Filed: Sep. 27, 2005

(51) Int. Cl.
*F02P 13/00* (2006.01)

(52) U.S. Cl. ..... 123/151; 123/152; 123/182.1

(58) Field of Classification Search ..... 123/182.1, 123/169 R, 151, 152
See application file for complete search history.

(56) References Cited

U.S. PATENT DOCUMENTS 2,173,607 A * 9/1939 Fowler ..... 123/169 R
3,589,348 A * 6/1971 Reichhelm ..... 123/169 PB
4,326,145 A * 4/1982 Foster et al. ..... 123/182.1
4,930,473 A * 6/1990 Dietrich ..... 123/266
5,245,963 A * 9/1993 Sabol et al. ..... 123/169 C
6,240,888 B1 * 6/2001 Pilney ..... 123/182.1
6,382,159 B1 * 5/2002 Shifflette ..... 123/169 R

* cited by examiner

*Primary Examiner*—Erick Solis
(74) *Attorney, Agent, or Firm*—Terry L. Miller

(57) ABSTRACT

A spark plug adapter allows for installation into the cylinder head of an internal combustion engine of an improved high-performance spark plug of configuration considerably different from that which the cylinder head was manufactured to accept. This is accomplished without disassembly of the engine or machine work on the cylinder head, and provides for a considerably improved smoothness of operation of and power production from the engine. An alternative embodiment of the inventive spark plug adapter provides for a compression release valve to communication with the combustion chamber of the engine, considerably easing starting for the engine, and still without disassembly of the engine or machine work on the cylinder head. A third embodiment of the inventive spark plug adapter provides for improved sealing of combustion gases.

7 Claims, 5 Drawing Sheets

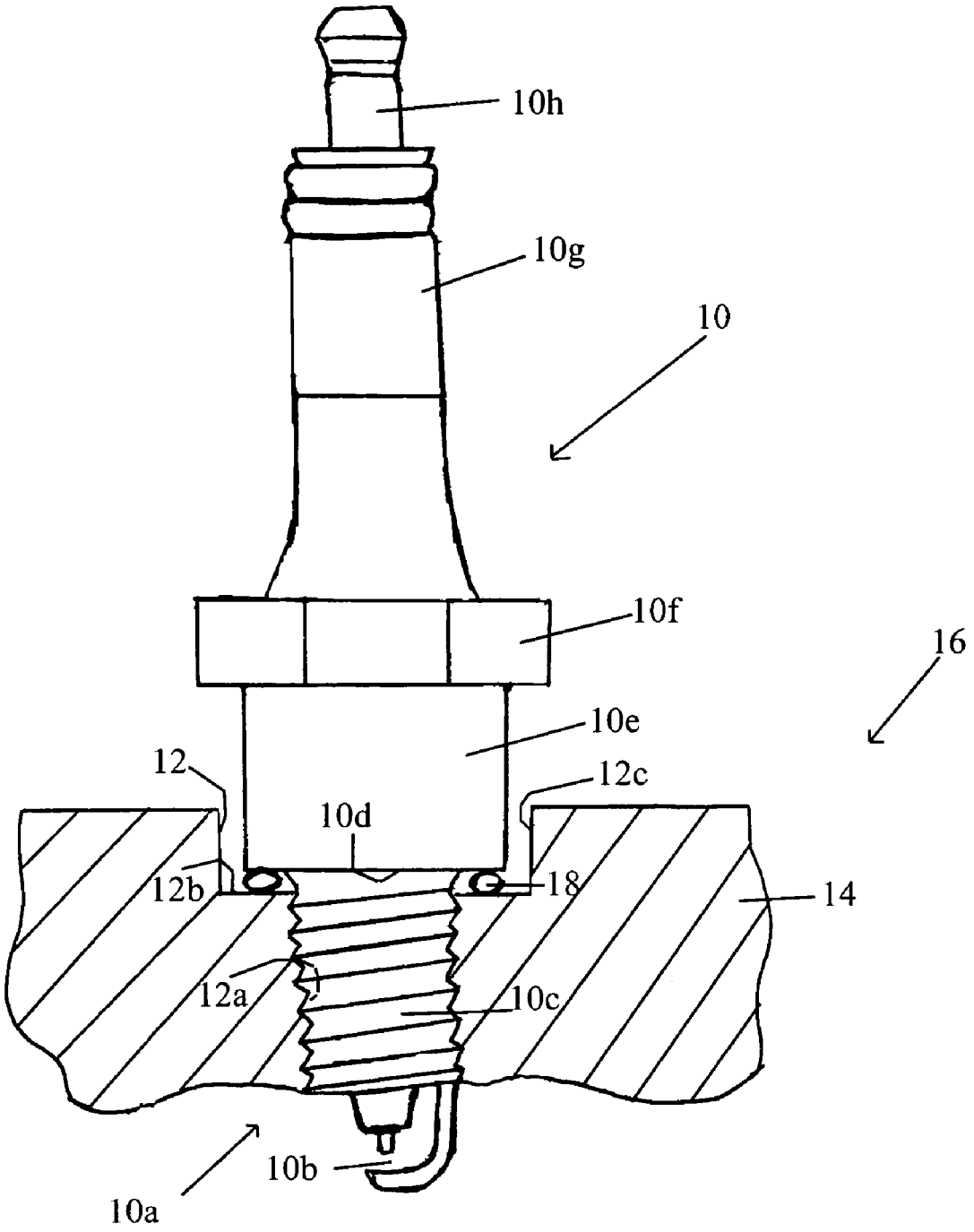
PRIOR ART Fig. 9

APPARATUS AND METHOD FOR IMPROVING ENGINE PERFORMANCE

FIELD OF THE INVENTION

The present invention relates to a device that can be added on to an internal combustion engine to promote improved performance and smoother operation. In particular, this invention relates to an adapter which is attachable to a spark plug port of an engine thereby allowing the installation of a spark plug which provides improved ignition and improved performance for the engine compared to the spark plug for which the engine was originally designed. Further, the adapter may be configured also to allow an auxiliary device, such as a compression pressure relief valve, to also be installed at the spark plug port.

BACKGROUND OF THE INVENTION

A problem with the typical internal combustion engine is the fact that each engine is designed to receive a particular type of spark plug. That is, the spark plug port of the engine will be machined and threaded at the time the engine is manufactured so that a particular configuration of spark plug will threadably engage into the spark plug port. Since the spark plug is attached by threads at its base to the spark plug port of the engine the threads of the spark plug must exactly match the threads in the spark plug port. Threads of spark plugs vary significantly, and some are designed to Metric measurements, while others are designed to English measurements. Additionally, the pitch and spacing of the threading have to match. In order to attach a spark plug to an engine that does not have the same threading as the spark plug the port has to be resized and re-threaded, perhaps by some type of welding and machining process. However, this can be a costly proposition.

FIG. 9 illustrates a conventional spark plug 10 threadably inserted into a port 12 of a conventional cylinder head 14 for an internal combustion engine 16. Those ordinarily skilled in the pertinent arts will understand that the remainder of the engine is not illustrated. The port 12 includes a threaded section 12*a*, a step 12*b* providing a sealing surface, and a counter bore section 12*c* opening outwardly on the cylinder head 14. Similarly, the conventional spark plug 10 includes an electrode section 10*a* providing a spark gap 10*b*, a threaded section 10*c* leading first to a sealing shoulder 10*d*, and to an external metallic body section 10*e*, which provides wrenching flats 10*f*. Above the metallic body section 10*e*, the conventional spark plug 10 includes an insulator section 10*g*, which is usually formed of ceramic. Atop of the insulator 10*g*, the conventional spark plug 10 carries a metallic contact 10*h*, which provides for connection of electrical potential to the spark plug 10 in order to effect a spark across gap 10*b*. A gasket 18 is sealingly captured between the shoulder 10*d* and sealing surface 12*b*. Some conventional spark plugs employ a tapered sealing surface which sealingly engages directly against a tapered seat of a cylinder head without the use of a gasket.

In view of the above, it is easily appreciated that the cylinder head 14 is configured and adapted at the time it is manufactured to accept only one configuration of spark plug, and that this adaptation of the cylinder head 14 is not easily changed. Some who desire to modify a conventional engine cylinder head will remove the cylinder head from its engine and possibly machine the port 12 to accept a different configuration of spark plug. Also, those who desire to make other modifications to a cylinder head, or to add additional devices to it, such as a compression release valve will also remove the cylinder head from its engine and have machining operations performed to make these modifications or to add the additional devices. However, each of these modifications involves disassembly of the engine, as well as machining operations, and can be prohibitively expensive.

Thus, what is needed is a device for allowing a spark plug of differing configuration to be employed in an engine having a conventional spark plug port. Further, a device for allowing a compression release valve to be connected at the conventional spark plug port of an engine would be an advantage.

SUMMARY OF THE INVENTION

Further to the above, the present invention according to one particularly preferred embodiment, provides a spark plug adapter particularly for use in an internal combustion engine and allowing utilization of a high-performance spark plug to improve combustion, engine smoothness and fuel economy, as well as power output, the internal combustion engine having a spark plug port including a threaded section opening to a combustion chamber of the engine, the spark plug port including a step adjacent to and outwardly of the threaded section and providing a sealing surface, and the spark plug port being configured to receive a conventional spark plug which in sequence along its length provides: an electrode section providing a spark gap in the combustion chamber of the engine, a metallic portion with a threaded portion for threadably engaging the threaded section of the spark plug port and leading from the electrode section first to a sealing shoulder engageable with the sealing surface, and an external metallic body section which provides wrenching flats, and which carries an insulator section with a metallic electrical contact; the spark plug adapter comprising: a body portion externally replicating the configuration of the conventional spark plug including the threaded section, the sealing shoulder, and the external body section with wrenching flats; the body portion internally defining a stepped through bore providing a substantially straight non-threaded bore portion within the threaded section, and the through bore opening at one end of the body portion to a combustion chamber of the engine, the bore portion extending internally of the body to an outwardly disposed and tapering seat section; a radially outwardly extending recess above the tapering seat section, and including a non-threaded section extending to a threaded section of the stepped through bore, and the threaded section opening on the body portion; whereby, the spark plug adapter is configured to receive a high-performance spark plug which in sequence along its length provides: an electrode section providing a spark gap, and an adjacent elongate metallic non-threaded cylindrical section, which leads to a tapering sealing shoulder, which is defined adjacent to a metallic threaded section, and leads to an external metallic body section, the external metallic body section providing plural wrenching flats, and carrying an insulator section with a metallic electrical contact.

Another aspect of the present invention provides a method for providing temporary pressure relief to a cylinder of an internal combustion engine comprising the steps of: providing an adapter configured to thread into a spark plug port on an internal combustion engine; configuring the adapter to receive a spark plug; detachably but securely connecting a pressure relief valve to the adapter and configuring the valve to provide a partial vent for gases in the cylinder when the valve is set in an open position; and closing the valve when pressure is the cylinder reaches a preset value.

Additional objects and advantages of the present invention will be apparent in view of a consideration of the following detailed description of particularly preferred exemplary embodiments, taken in conjunction with the appended drawing Figures.

BRIEF DESCRIPTION OF THE DRAWINGS

The invention will be better understood by an examination of the following description, together with the accompanying drawings, in which:

FIG. 9 provides a view of a conventional cylinder head and spark plug.

DETAILED DESCRIPTION OF THE PREFERRED EMBODIMENTS

Figure 1:
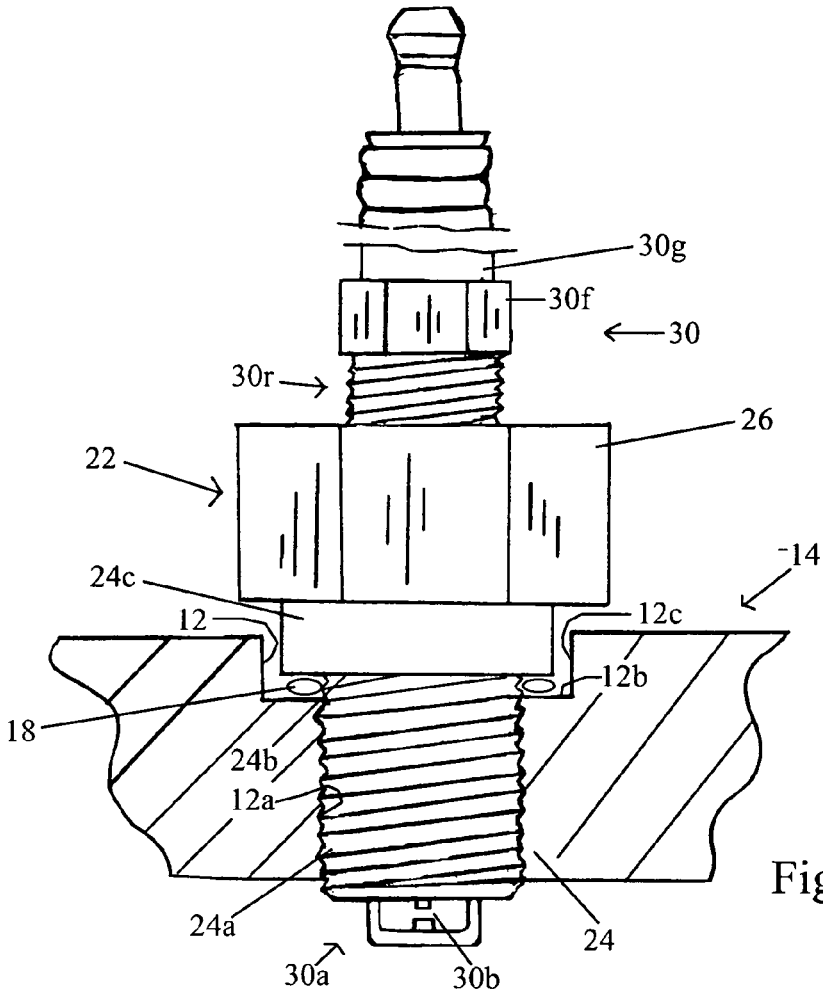
FIG. 1 provides a fragmentary side elevation view, partially in cross section, of an adapter according to the present invention installed in a conventional cylinder head, and threadably receiving a spark plug of considerably different configuration than what the cylinder head is configured to accept, with part of the spark plug broken away for ease of illustration.

FIG. 1 illustrates a conventional cylinder head 14 for an internal combustion engine 16. The cylinder head 14 is essentially the same as the cylinder head 14 seen in FIG. 9, and includes a port 12 with a threaded section 12*a*, a step 12*b* providing a sealing surface, and a counter bore section 12*c* opening outwardly on the cylinder head 14. However, threadably received into the port 12 is an adapter 20 according to the present invention. The adapter 20 sealingly engages a gasket 18, essentially the same as gasket 18 seen in FIG. 9.

Moreover, this adapter 20 includes a body 22 which at a lower portion 24 replicates the configuration of the conventional spark plug 10. That is, the adapter lower portion 24 includes an externally threaded section 24*a* threadably engaging into the cylinder head 14, and leading to a sealing shoulder 24*b*. Above, the sealing shoulder 24*b*, the lower portion 24 includes a cylindrical section 24*c*, and the body 22 above the section 24*c* defines plural wrenching flats 26 (i.e., cooperatively defining a hexagonal configuration) providing for the adapter 20 to be tightened into the cylinder head 14. The body 22 includes an essentially flat upper surface 28.

Figure 2:
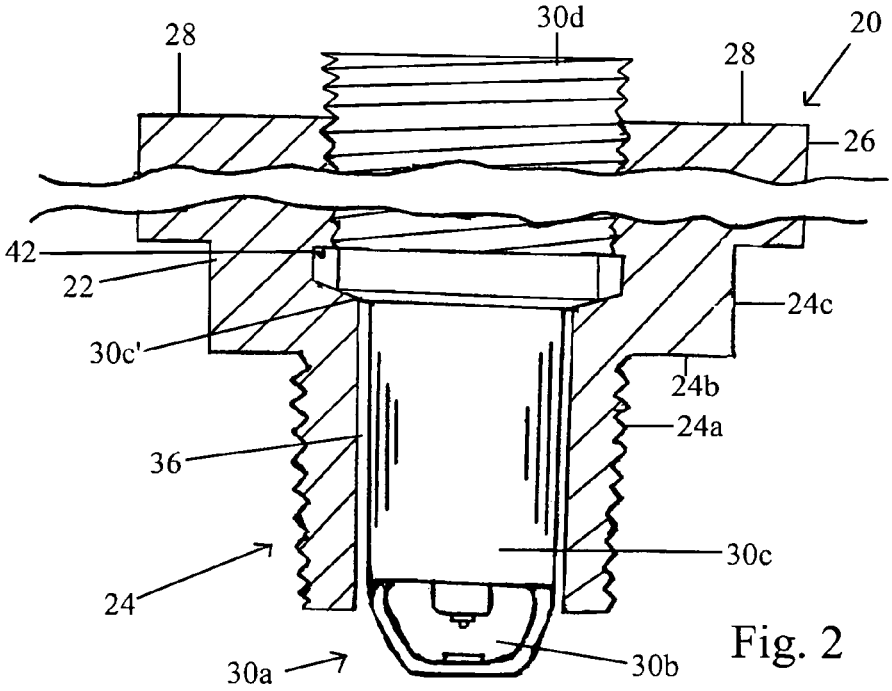
FIG. 2 depicts a fragmentary side elevation view, also partially in cross section, and at a somewhat enlarged size, of the adapter and spark plug seen in FIG. 1, with part of the vertical dimension of the adapter and spark plug broken out for clarity of illustration.

Further, Viewing FIGS. 1 and 2 in conjunction with one another, it is seen that the adapter 20 provides for use in the cylinder head 14 of a spark plug 30 of considerably different configuration than the one for which the cylinder head 14 was originally manufactured, recalling FIG. 9. Specifically, the spark plug that would be used in the current preferred embodiment would be a Motorcraft® platinum PZT2FE sparkplug. That is, viewing FIGS. 1 and 2, it is seen that the spark plug 30 includes an electrode section 30*a* providing a spark gap 30*b*, and an adjacent elongate metallic non-threaded cylindrical section 30*c*. The cylindrical section 30*c* leads to a tapering sealing shoulder 30*c*', which is defined adjacent to a metallic threaded section 30*d*, and leads to an external metallic body section 30*e* (best seen in FIG. 1). As with the body section 10*e* of the spark plug 10 (recalling FIG. 9), the external metallic body section 30*e* provides plural wrenching flats 30*f*.

Above the metallic body section 30*e* and the wrenching flats 30*f*, the spark plug 30 includes an insulator section 30*g* (only part of which is seen in FIG. 1) formed of ceramic. Atop of the insulator 30*g*, the spark plug 30 carries a metallic contact 30*h*, which provides for connection of electrical potential to the spark plug 30 in order to effect a spark across gap 30*b*.

Figure 3:
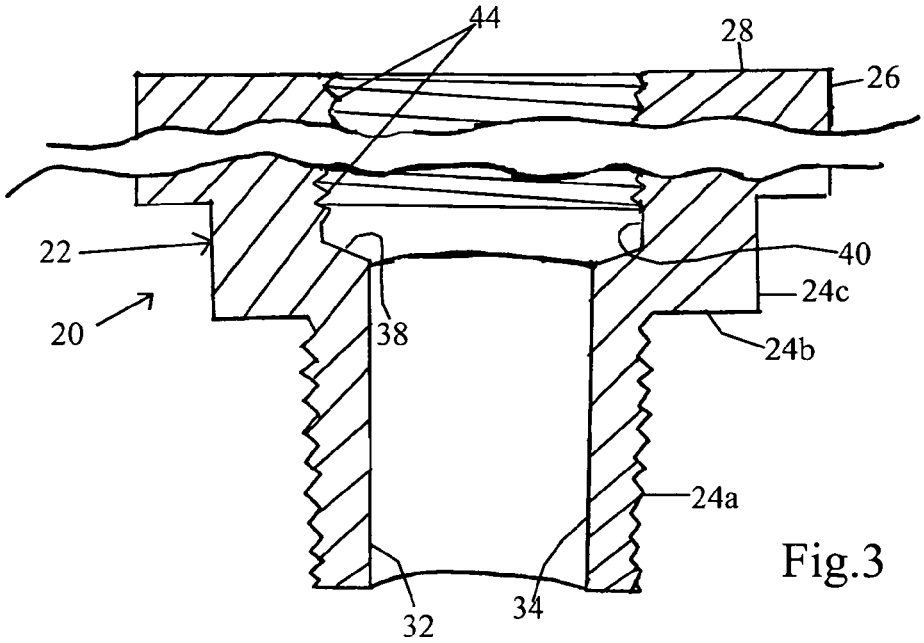
FIG. 3 provides a fragmentary cross sectional view of a the adapter seen in FIG. 2, but without the spark plug, and with part of the vertical dimension of the adapter broken out for ease of illustration.

Turning now to the further details of the adapter 20, and viewing particularly FIG. 3, it is seen that this adapter 20 internally defines a stepped through bore 32, which in some respects is formed as a compliment to the lower portions of the spark plug 30. That is, the stepped bore 32 includes a first bore section 34 opening downwardly on the body 22 (i.e., toward the combustion chamber of the engine) and having an inner diameter which is slightly larger than the outer diameter of the unthreaded section 30*c* of the spark plug 30. That is, the bore 32 at bore section 34 defines a gap 36 (best seen in FIG. 2) in cooperation with the section 30*c* of the spark plug 30. Above the bore section 34, the body 22 defines a tapering sealing seat 38 which is complimentary to and sealingly engageable with the shoulder 30*c*' on the spark plug 30. Next above the sealing seat 38, the body 22 defines an annular space 40 (or radially outwardly extending recess), which cooperates with the body section 30*d* of the spark plug 30 to define an annular chamber 42 (best seen in FIG. 2). And finally, above the annular space 40, the body 22 defines an internally threaded section 44 opening on the surface 28 of the body 22.

FIG. 2 shows that the spark plug 30 protrudes a sufficient distance below the adapter 20 that the spark gap 30*b* is exposed to the combustion chamber of an engine into which the adapter 20 and spark plug 30 are installed at a conventional spark plug port. Adapter 20 is thus designed to properly position the spark plug 30 inside the engine cylinder so that it properly delivers the spark to ignite a fuel mixture injected into the engine cylinder. Tests of the preferred spark plug and adapter 20 have shown a considerable improvement in the initiation of combustion in the cylinder of a conventional internal combustion 4-stroke gasoline engine in comparison to the performance of this same engine when using the conventional spark plugs for which it was manufactured. That is, an improved combustion, smoothness of operation, and power output resulted, as well as an improvement in fuel economy.

Figure 4:
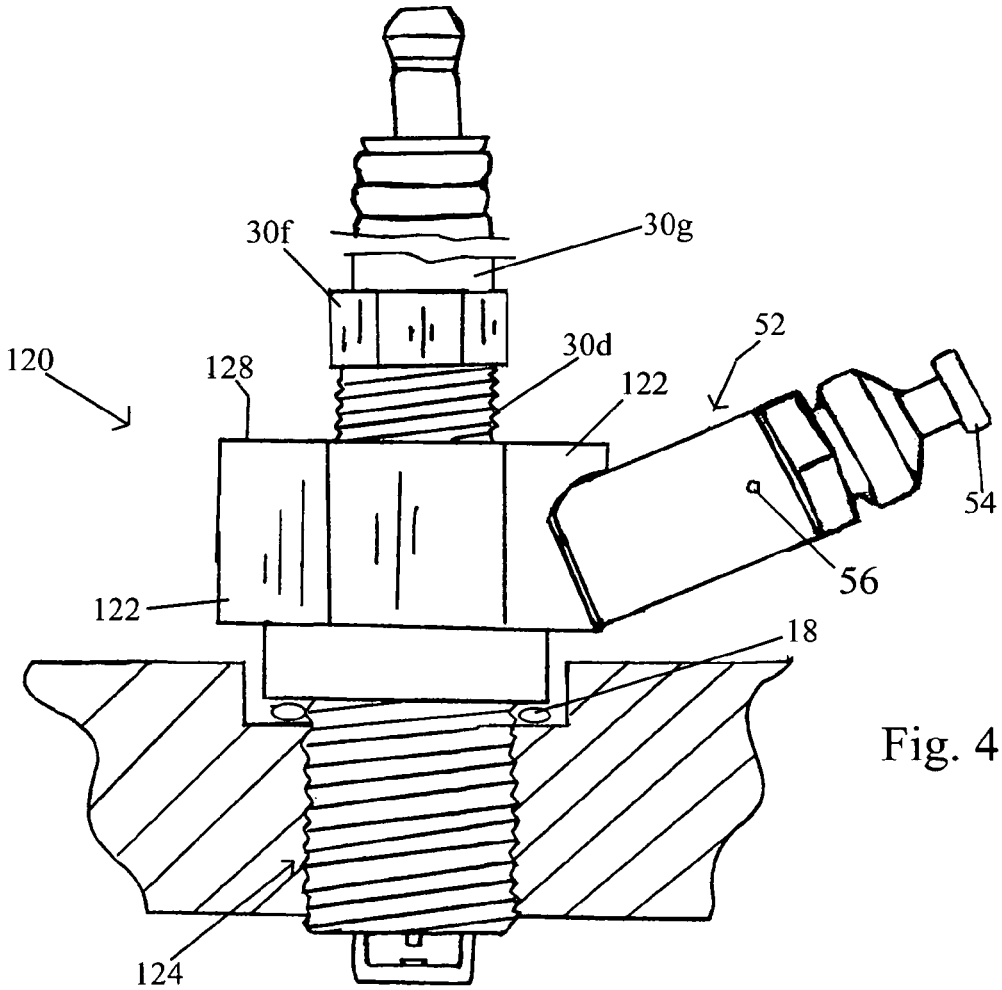
FIG. 4 is a fragmentary view, partially in cross section, and similar to that of FIG. 1, but illustrates an alternative embodiment of an adapter according to the present invention which carries a compression release valve also.
Figure 5:
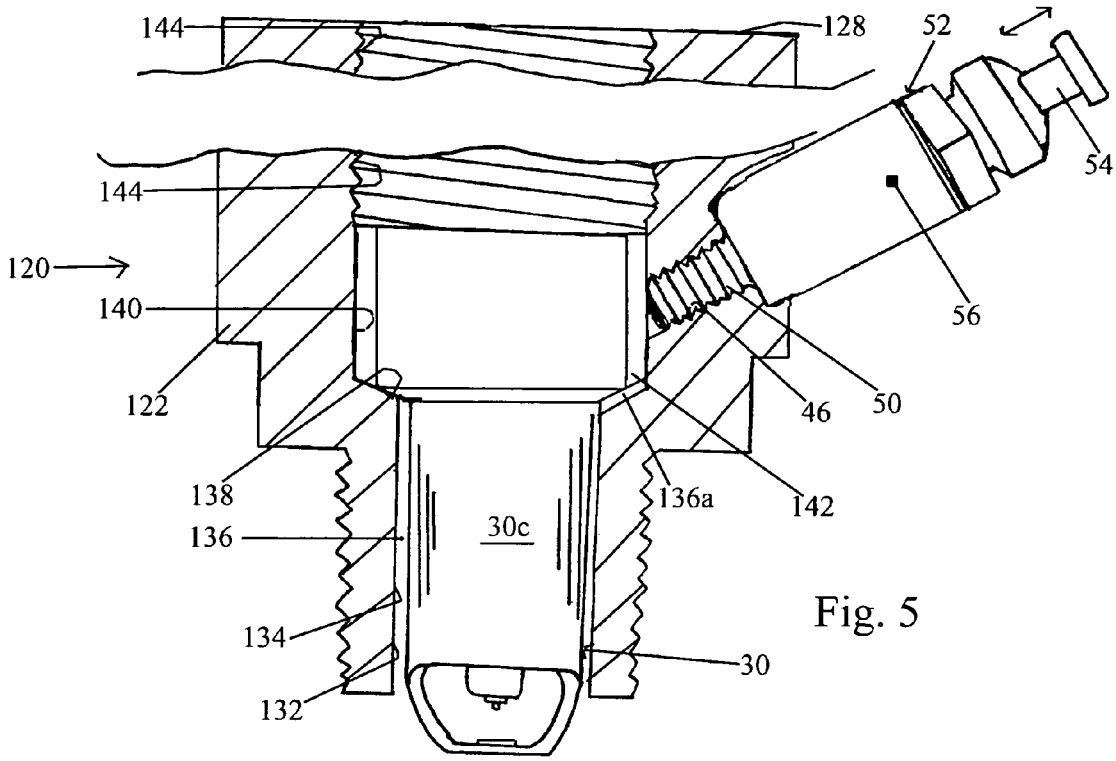
FIG. 5 provides an enlarged fragmentary view, partially in cross section, of the adapter and spark plug seen in FIG. 4, with part of the vertical dimension of the adapter and spark plug broken out for clarity of illustration.
Figure 6:
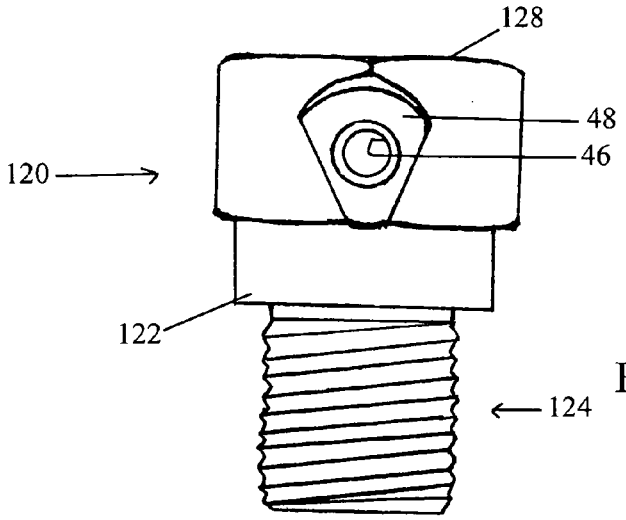
FIG. 6 is a side elevation view of the adapter seen in FIGS. 4 and 5, and is taken in the plane of FIG. 5 from the right hand side, and with the compression release valve removed in order to better illustrate features of the adapter.

FIGS. 4–6 illustrate an alternative embodiment (i.e., second embodiment) of the present invention. Because this second embodiment has many features in common with the first embodiment described above, features of FIGS. 4–6 which are the same as or which are analogous in structure or function to, those described above, are referenced using the same numeral used above, but increased by one-hundred (100). Turning now to FIG. 4 it is seen that a spark plug adapter 120 includes a body 122 which at a lower portion 124 replicates the configuration of the conventional spark plug 10 (recalling FIG. 9). This provides for the adapter 120 to be tightened into the spark plug port 12 of a conventional cylinder head 14 (again recalling FIG. 9).

The body 122 includes an essentially flat upper surface 128, and provides for use in the cylinder head 14 of a spark plug 30 of considerably different configuration than the one for which the cylinder head 14 was originally manufactured, recalling FIG. 9 again. The spark plug 30 is the same as the one described by reference to FIGS. 1–3, and will not be described further. However, it is noted again that the spark plug that would be used in the current preferred embodiment would be a Motorcraft® platinum PZT2FE sparkplug.

Turning now to the further details of the adapter 120, and viewing particularly FIGS. 5 and 6, it is seen that this adapter 120 internally defines a stepped through bore 132, which in some respects is formed as a compliment to the lower portions of the spark plug 30. That is, the stepped bore 132 includes a first bore section 134 opening downwardly on the body 122 (i.e., toward the combustion chamber of the engine) and having an inner diameter which is slightly larger than the outer diameter of the unthreaded section 30*c* of the spark plug 30. That is, the bore 132 at bore section 134 defines a gap 136 (best seen in FIG. 5) in cooperation with the section 30*c* of the spark plug 30. Above the bore section 134, the body 122 defines a tapering sealing seat 138 which is complimentary to and sealingly engageable with the shoulder 30*c*' on the spark plug 30. Next above the sealing seat 138, the body 122 defines an annular space 140 (or radially outwardly extending recess), which cooperates with the body section 30*d* of the spark plug 30 to define an annular chamber 142 (best seen in FIG. 5). And finally, above the annular space 140, the body 122 defines an internally threaded section 144 opening on the surface 128 of the body 122. Communicating between the gap space 136 and the annular chamber 142, the body 122 defines a rather small and rather shallow recess 136*a*.

As is best seen viewing FIGS. 5 and 6, the body 122 further defines a small angulated bore 46 communication from the annular chamber 142 outwardly on the body 122 to open in an angulated spot face or seat 48. The bore 46 is threaded to threadably receive the tubular stem 50 of a compression release valve 52. This compression release valve 52 is conventional in the art, and will thus not be described further other than to note that the valve 52 includes a control knob 54 which when pushed inwardly (noting the double-headed arrow on FIG. 5) communicates the hollow stem of this valve to ambient via a small opening or hole 56 on the side of this valve 52.

When the compression release valve 52 is exposed at the hollow stem 50 to the high pressures which indicate that combustion is taking place in a cylinder of an internal combustion engine, then the stem 54 will return to its outward position, closing communication between the hollow stem 50 and the opening 56. In this way, the compression release valve may be used as a starting compression release to facilitate starting of a high-compression engine which otherwise might be difficult or impossible to start with a conventional electric or kick starter.

That is, in preparation for starting an engine employing the adapter 120 the user of the engine pushes inwardly on the knob 54, providing a compression leakage path along clearance gap 136, recess 136*a*, annular chamber 142, bore 46, hollow stem 50, internally of the valve 52, and to the opening 56. The user then activates the electric starter, or employs the kick starter of the engine. The slight amount of compression gases that are allowed to thus escape from the engine during starting (i.e., during operation of the electric or kick starter) facilitates easier cranking of the engine. This easing of the cranking burden for the engine can be critical in the case of high compression or modified engines, such as high-performance motorcycle engines. However, when first the engine fires and begins running, the compression release valve 52 automatically closes in response to combustion pressure (as opposed to cranking pressure), and full compression ratio for the engine is restored.

Figure 7:
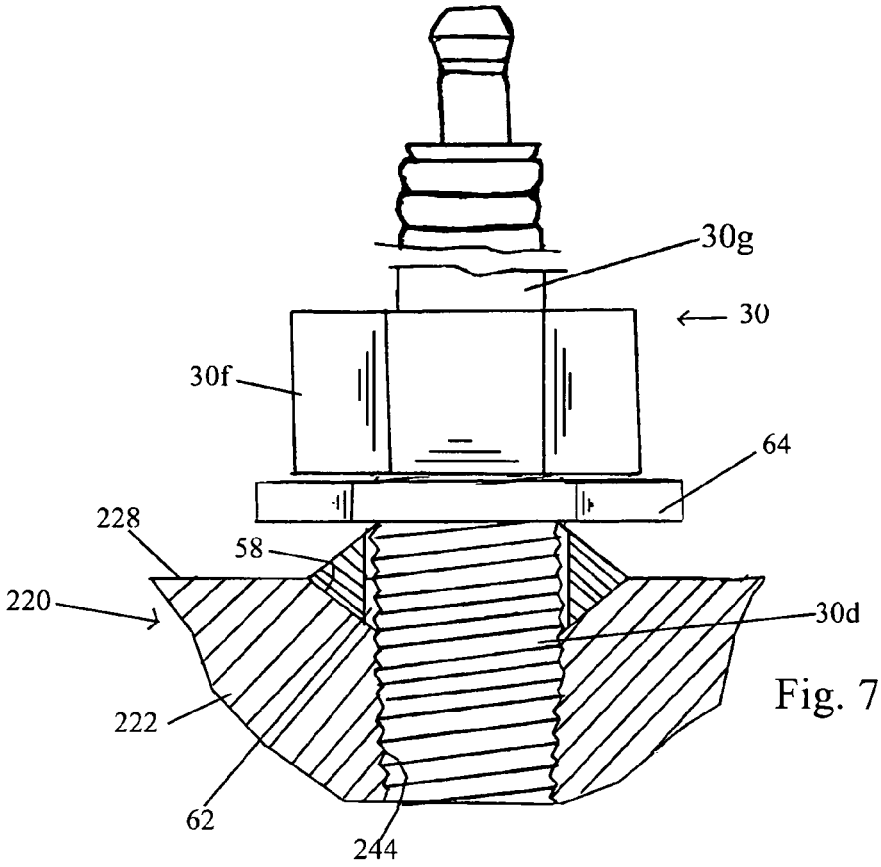
FIG. 7 provides a fragmentary side elevation view, partially in cross section, of yet another alternative embodiment of spark plug adapter according to the present invention.
Figure 8:
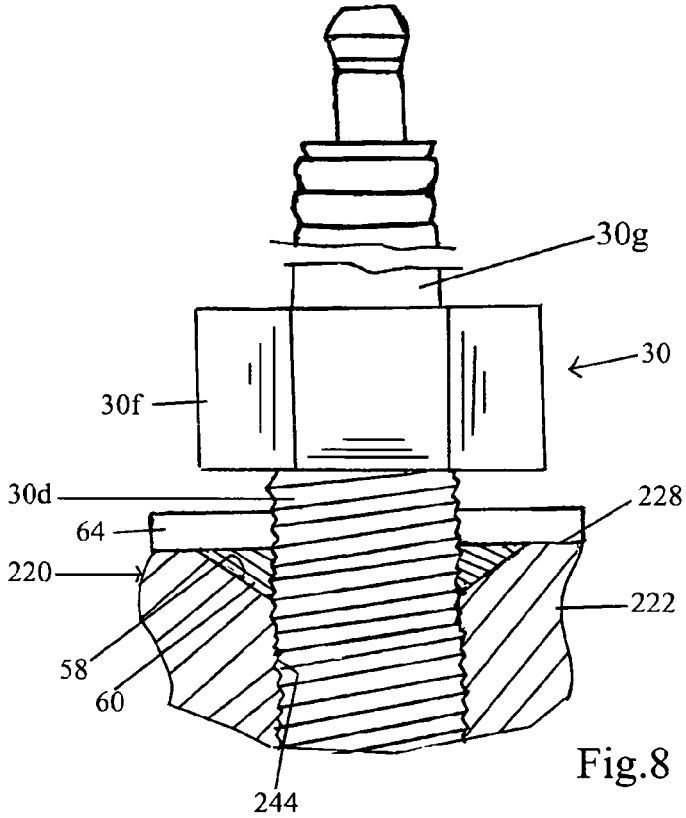
FIG. 8 is a fragmentary side elevation view, similar to that of FIG. 7, but showing the adapter of the present invention along with a spark plug and a seal with packing nut, preparatory to finishing of the assembly.

FIGS. 7 and 8 illustrate yet another alternative embodiment (i.e., third embodiment) of the present invention. Because this third embodiment has many features in common with the first and second embodiments described above, features of FIGS. 7 and 8 which are the same as or which are analogous in structure or function to, those described above, are referenced using the same numeral used above, but increased by two-hundred (200). In deed, the alternative embodiment of FIGS. 7 and 8 presents a modification of the body 122 of the spark plug adapter 120 seen in FIGS. 4–6 (along with two new parts not previously described or depicted), as will be appreciated in view of the following. Turning now to FIG. 7 it is seen that a spark plug adapter 220 includes a body 222 which includes a lower portion 224 (not seen in the drawing Figures) which replicates the configuration of the conventional spark plug 10 (recalling FIG. 9). This provides for the adapter 220 to be tightened into the spark plug port 12 of a conventional cylinder head 14 (again recalling FIG. 9).

The body 222 includes an upper surface 228, which in this embodiment is not entirely flat. A bore 244 opens on this surface 228 within a conical spot face or recess 58. The bore 244 provides for use in the adapter 220 of a spark plug 30 the same as the one described by reference to FIGS. 1–6, and the adapter below the body portion 222 will not be described further. However, it is noted again that the spark plug that would be used in the current preferred embodiment would be a Motorcraft® platinum PZT2FE sparkplug.

Turning now to the further details of the adapter 220, and viewing particularly FIG. 7, it is seen that subsequent to the installation of the spark plug 30 into the adapter, a malleable sealing or packing member 60 is received about the threaded body portion 30*d* and into the recess 58. This packing member 60 in its new condition is malleable and defines a clearance 62 with the threaded portion 30*d* of the spark plug 30. This packing member 60 may be made of asbestos or possibly of PTFE Teflon®, for example. Thus, a user of the adapter 220 may slip the packing member 60 onto the spark plug threads 30*d* before threading the spark plug 30 into the adapter 220.

But, viewing FIG. 7, it is seen that the user has also threadably installed a thin gland nut 64 onto the threaded portion 30*d* of the spark plug above the packing member 60. At the time the spark plug 30 is installed and tightened into the adapter 220, the gland nut is high on the threaded section 30*d*, and defines a clearance with the top surface 228 of the adapter 220, and with the packing member 60. However, after the spark plug 30 is securely tightened into the adapter 220, the gland nut 64 is tightened onto the packing member 60 (viewing now FIG. 8), urging this packing member 60 forcefully into recess 58. This tightening of the gland nut 64 onto the packing member 60 both contracts the internal diameter of the packing member 60 sealingly into engagement with the thread section 30*d* of the spark plug 30, and substantially compresses the packing member 60 into the recess 58, as is seen in FIG. 8. Subsequently, when the engine into which the adapter 220 and spark plug 30 are installed is operated, engine heat cures the malleable packing member 60 (if made of asbestos, for example) into a tenacious sealing relation both with the spark plug 30 at thread section 30*d*, and with the adapter 220 at recess 58. On the other hand, a packing member made of PTFE Teflon® will likely remain malleable and can possibly be reused several times. In this way, combustion pressures and gases which enter the chamber 142 (recalling FIG. 5) are prevented from leaking outwardly along the threads 30*d* of the spark plug 30.

While the invention has been particularly shown and described with reference to a preferred embodiment thereof, it will be understood by those skilled in the art that various changes in form and detail may be made to it without departing from the spirit and scope of the invention.

I claim:

1. A spark plug adapter particularly for use in an internal combustion engine and allowing utilization of a high-performance spark plug to improve combustion, engine smoothness and fuel economy, as well as power output, the internal combustion engine having a spark plug port including a threaded section opening to a combustion chamber of the engine, the spark plug port including a step adjacent to and outwardly of the threaded section and providing a sealing surface, and the spark plug port being configured to receive a conventional spark plug which in sequence along its length provides: an electrode section providing a spark gap in the combustion chamber of the engine, a metallic portion with a threaded portion for threadably engaging the threaded section of the spark plug port and leading from the electrode section first to a sealing shoulder engageable with the sealing surface, and an external metallic body section which provides wrenching flats, and which carries an insulator section with a metallic electrical contact;

said spark plug adapter comprising:

a body portion externally replicating the configuration of said conventional spark plug including said threaded section, said sealing shoulder, and said external body section with wrenching flats;

said body portion internally defining a stepped through bore providing a substantially straight non-threaded bore portion within said threaded section, and said through bore opening at one end of said body portion to a combustion chamber of said engine, said bore portion extending internally of said body to an outwardly disposed and tapering seat section;

a radially outwardly extending recess above said tapering seat section, and including a non-threaded section extending to a threaded section of said stepped through bore, and said threaded section opening on said body portion;

whereby, said spark plug adapter is configured to receive a high-performance spark plug which in sequence along its length provides: an electrode section providing a spark gap, and an adjacent elongate metallic non-threaded cylindrical section, which leads to a tapering sealing shoulder, which is defined adjacent to a metallic threaded section, and leads to an external metallic body section, the external metallic body section providing plural wrenching flats, and carrying an insulator section with a metallic electrical contact.

2. The spark plug adapter of claim 1 wherein said substantially straight non-threaded bore portion within said threaded section is sized to provide a radial gap circumscribing said elongate metallic non-threaded cylindrical section of said spark plug.

3. The spark plug adapter of claim 2 wherein said radial gap extends from adjacent to said electrode section and spark gap within a combustion chamber of the engine to said tapering sealing shoulder.

4. A combination spark plug adapter and compression release device particularly for use in an internal combustion engine and allowing utilization of a high-performance spark plug to improve combustion, engine smoothness and fuel economy, as well as power output, and also providing for temporary compression release to facilitate easier starting of the engine;

the internal combustion engine having a spark plug port including a threaded section opening to a combustion chamber of the engine, the spark plug port including a step adjacent to and outwardly of the threaded section and providing a sealing surface, and the spark plug port being configured to receive a conventional spark plug which in sequence along its length provides: an electrode section providing a spark gap in the combustion chamber of the engine, a metallic portion with a threaded portion for threadably engaging the threaded section of the spark plug port and leading from the electrode section first to a sealing shoulder engageable with the sealing surface, and an external metallic body section which provides wrenching flats, and which carries an insulator section with a metallic electrical contact;

said device comprising:

a body portion externally replicating the configuration of said conventional spark plug including said threaded section, said sealing shoulder, and said external body section with wrenching flats;

said body portion internally defining a stepped through bore providing a substantially straight non-threaded bore portion within said threaded section, and said through bore opening at one end of said body portion to a combustion chamber of said engine, said bore portion extending internally of said body to an outwardly disposed and tapering seat section;

a radially outwardly extending recess above said tapering seat section, and including a non-threaded section extending to a threaded section of said stepped through bore, and said threaded section opening on said body portion;

whereby, said device is configured to receive a high-performance spark plug which in sequence along its length provides: an electrode section providing a spark gap, and an adjacent elongate metallic non-threaded cylindrical section, which leads to a tapering sealing shoulder, which is defined adjacent to a metallic threaded section, and leads to an external metallic body section, the external metallic body section providing plural wrenching flats, and carrying an insulator section with a metallic electrical contact;

and wherein said substantially straight non-threaded bore portion within said threaded section is sized to provide a radial gap circumscribing said elongate metallic non-threaded cylindrical section of said spark plug, said radial gap extends from adjacent to said electrode section and spark gap within a combustion chamber of the engine to said tapering sealing shoulder, a recess defined by said body portion communicating across said tapering seat section and to an annular chamber defined within said radially outwardly extending recess above said tapering seat section, a bore communicating outwardly from said annular chamber, and said body portion carrying a pressure-responsive compression release valve communicating with said bore;

whereby, said compression release valve in a starting condition provides limited communication of pressurized gas from said combustion chamber along said radial gap, along said recess, to said annular chamber, and along said bore to said compression release valve and to ambient; in a second condition said compression release valve closing said communication.

5. The device of claim 4 further including said body portion defining a recess adjacent to said opening of said threaded bore portion on said body, a packing member received into said recess, and a gland nut threadable on said threaded section of the high performance spark plug and engageable with said packing member to sealingly engage said packing member with said threaded section of said high performance spark plug.

6. A method of adapting a high-performance spark plug to an internal combustion engine not configured to receive the high-performance spark plug in order to improve combustion, engine smoothness, fuel economy, as well as power output for the engine;

the internal combustion engine having a spark plug port including a threaded section opening to a combustion chamber of the engine, the spark plug port including a step adjacent to and outwardly of the threaded section and providing a sealing surface, and the spark plug port being configured to receive a conventional spark plug which in sequence along its length provides: an electrode section providing a spark gap in the combustion chamber of the engine, a metallic portion with a threaded portion for threadably engaging the threaded section of the spark plug port and leading from the electrode section first to a sealing shoulder engageable with the sealing surface, and an external metallic body section which provides wrenching flats, and which carries an insulator section with a metallic electrical contact;

the high performance spark plug contrasting to the conventional spark plug in providing in sequence along its length provides: an electrode section providing a spark gap, and an adjacent elongate metallic non-threaded cylindrical section, which leads to a tapering sealing shoulder, which is defined adjacent to a metallic threaded section, and leads to an external metallic body section, the external metallic body section providing plural wrenching flats, and carrying an insulator section with a metallic electrical contact;

said method comprising steps of:

providing an adapter with a body portion externally replicating the configuration of said conventional spark plug including said threaded section, said sealing shoulder, and said external body section with wrenching flats;

configuring said body portion internally to define a stepped through bore providing a substantially straight non-threaded bore portion within said threaded section, and said through bore opening at one end of said body portion to a combustion chamber of said engine, said bore portion extending internally of said body to an outwardly disposed and tapering seat section;

providing a radially outwardly extending recess above said tapering seat section, and including a non-threaded section extending to a threaded section of said stepped through bore, and said threaded section opening on said body portion;

whereby, said adapter is configured to receive the high-performance spark plug.

7. A method of providing both improved performance and improved ease of starting of an internal combustion engine by adapting a high performance spark plug to the engine, and by providing a pressure-responsive compression relief valve all without disassembly or modification of the engine, said method including steps of;

employing an internal combustion engine having a spark plug port including a threaded section opening to a combustion chamber of the engine, the spark plug port including a step adjacent to and outwardly of the threaded section and providing a sealing surface, and the spark plug port being configured to receive a conventional spark plug which in sequence along its length provides: an electrode section providing a spark gap in the combustion chamber of the engine, a metallic portion with a threaded portion for threadably engaging the threaded section of the spark plug port and leading from the electrode section first to a sealing shoulder engageable with the sealing surface, and an external metallic body section which provides wrenching flats, and which carries an insulator section with a metallic electrical contact;

employing a high performance spark plug which is not compatible with the spark plug port, and includes in sequence along its length: an electrode section providing a spark gap, and an adjacent elongate metallic non-threaded cylindrical section, which leads to a tapering sealing shoulder, which is defined adjacent to a metallic threaded section, and leads to an external metallic body section, the external metallic body section providing plural wrenching flats, and carrying an insulator section with a metallic electrical contact;

providing a body portion externally replicating the configuration of said conventional spark plug including said threaded section, said sealing shoulder, and said external body section with wrenching flats;

configuring said body portion internally to define a stepped through bore providing a substantially straight non-threaded bore portion within said threaded section, and said through bore opening at one end of said body portion to a combustion chamber of said engine, said bore portion extending internally of said body to an outwardly disposed and tapering seat section;

providing a radially outwardly extending recess above said tapering seat section, and including a non-threaded section extending to a threaded section of said stepped through bore, and said threaded section opening on said body portion;

configuring said substantially straight non-threaded bore portion within said threaded section to provide a radial gap circumscribing said elongate metallic non-threaded cylindrical section of said high performance spark plug, said radial gap extends from adjacent to said electrode section and spark gap within a combustion chamber of the engine to said tapering sealing shoulder;

forming a recess defined by said body portion communicating across said tapering seat section and to an annular chamber defined within said radially outwardly extending recess above said tapering seat section;

providing a bore communicating outwardly from said annular chamber, and on said body portion carrying a pressure-responsive compression release valve communicating with said bore;

whereby, said compression release valve in a starting condition provides limited communication of pressurized gas from said combustion chamber along said radial gap, along said recess, to said annular chamber, and along said bore to said compression release valve and to ambient; in a second condition said compression release valve closing said communication.

* * * * *